United States Patent [19]

Horian

[11] Patent Number: 4,747,721

[45] Date of Patent: May 31, 1988

[54] OPENABLE RING TYPE LOOSE-LEAF NOTEBOOK

[76] Inventor: Richard C. Horian, 889 Cutler Rd., Longwood, Fla. 32779

[21] Appl. No.: 7,103

[22] Filed: Jan. 27, 1987

[51] Int. Cl.[4] ..... B42F 13/00; B42D 3/00; B42C 7/00

[52] U.S. Cl. ..... 402/73; 281/29; 412/3

[58] Field of Search ..... 402/73, 74, 75, 76, 402/77, 78, 31, 502, 80 R, 80 P; 428/106, 533; 281/36, 45, 29, 34, 35, 37; 283/64; 412/3, 17

[56] References Cited

U.S. PATENT DOCUMENTS

| | | | |
|---|---|---|---|
| 121,671 | 12/1871 | Shannon . | |
| 385,433 | 7/1888 | Underwood . | |
| 440,646 | 11/1890 | Ohmer . | |
| 809,557 | 1/1906 | Dumas . | |
| 841,920 | 1/1907 | Barsachs . | |
| 1,346,328 | 7/1920 | Manny . | |
| 1,910,792 | 5/1933 | Daniels | 402/74 |
| 2,284,009 | 5/1942 | Murphy | 281/36 |
| 2,362,118 | 2/1943 | Dawson, Jr. . | |
| 2,373,738 | 4/1945 | Atwood | 428/106 |
| 3,175,847 | 3/1965 | McKowen | 281/36 |
| 3,686,061 | 8/1972 | Brown et al. | 428/106 |
| 3,773,604 | 11/1973 | Desai et al. | 428/106 |
| 4,441,950 | 4/1984 | Lolli | 281/21 R |
| 4,571,109 | 2/1986 | Lapertosa | 402/31 |

*Primary Examiner*—Paul A. Bell
*Attorney, Agent, or Firm*—Brooks & Kushman

[57] ABSTRACT

A loose-leaf notebook (10) including a spine (12) on which a ring assembly (14) with openable rings (18) is mounted includes front and back cover flaps (22,24) of plywood with a generally uniform thickness in the range of about 0.08 to 0.18 of an inch. The plywood cover flaps (22,24) provide a lightweight, high strength, rigid construction and each has an outer exposed wood surface (28) that facilitates writing on the notebook as well as providing an aesthetically appealing appearance. A hinge (30) of the notebook is preferably embodied by a flexible hinge strip (38) such as adhesive backed decorative vinyl that secures the front and back cover flaps (22,24) to the spine (12) for movement between open and closed positions.

8 Claims, 1 Drawing Sheet

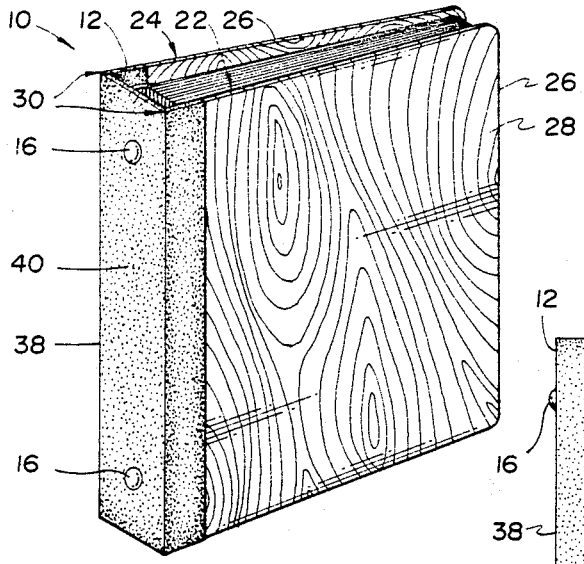
Fig. 1
Fig. 2
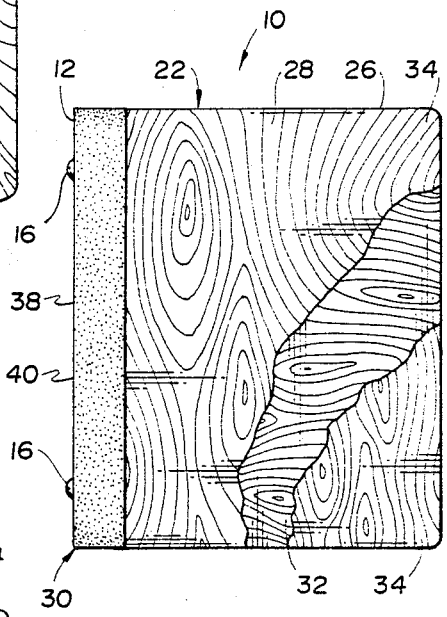
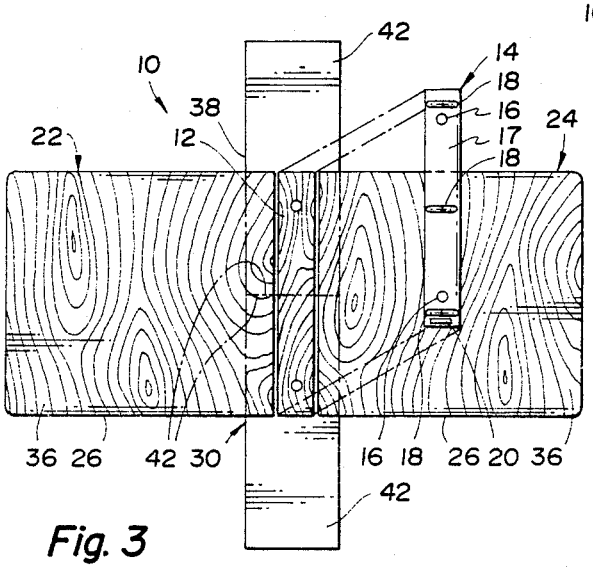
Fig. 3
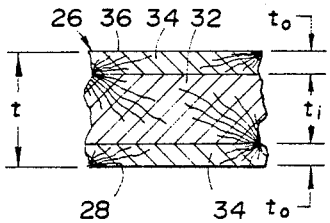
Fig. 4
Fig. 5
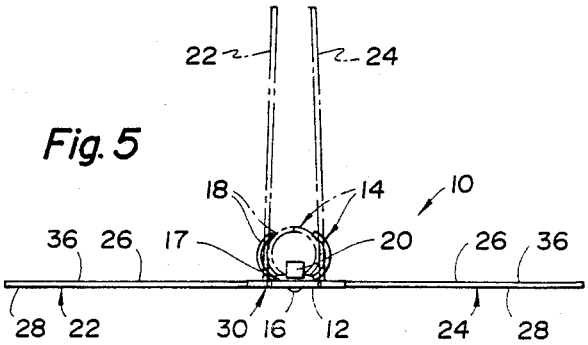

OPENABLE RING TYPE LOOSE-LEAF NOTEBOOK

TECHNICAL FIELD

This invention relates to an openable ring type loose-leaf notebook.

BACKGROUND ART

Conventional openable ring type loose-leaf notebooks include cardboard cover flaps that are secured by a cloth or vinyl cover of the notebook to a spine on which a ring assembly with openable rings is mounted. Such cardboard cover flaps provide only limited structural integrity to the notebook. Furthermore, the cloth, vinyl, or other materials conventionally utilized to cover the cardboard flaps are subject to fraying, tearing, and other wear especially at the outer edges and corners of the cover flaps which are exposed to the greatest degree of handling during use. Furthermore, the cloth, vinyl, and other cover materials conventionally used to provide the hinge connection of cover flaps to the notebook spine provide only a limited aesthetically appealing appearance. Also, conventional covering materials for cover flaps of openable ring type notebooks are not sufficiently rigid, hard, and smooth to permit ease of writing on the outside of the closed notebook as is often advantageously desirable.

Upon conducting a search for the present invention, certain non-ring type binders were noted. While these non-ring type binders are believed to be nonanalagous to the present invention, disclosure of the references is hereby being made of record so there can be no question that Applicant has complied with the duty of disclosure under patent practice. These prior art references having non-ring type binders include U.S. Pat. Nos.: 121,671 Shannon; 385,433 Underwood; 440,646 Ohmer; 809,557 Dumas; 841,920 Barsachs; 1,346,328 Manny; and 2,362,118 Dawson, Jr.

DISCLOSURE OF INVENTION

An object of the present invention is to provide an improved openable ring type loose-leaf notebook that has a lightweight, high strength, rigid construction, an aesthetically appealing appearance, sufficient hardness and smoothness to permit ease of writing on the notebook when desired, and edges and corners that do not wear or fray.

In carrying out the above object and other objects, a loose-leaf notebook constructed in accordance with the present invention includes an elongated spine and an elongated ring assembly that is secured to the spine and has a plurality of openable rings for detachably securing loose-leaf pages. Front and back cover flaps of the notebook each are made of plywood of a generally uniform thickness in the range of about 0.08 to 0.18 of an inch in order to provide the required rigidity and strength without excessive weight. Each cover flap has an outer exposed wood surface that provides sufficient hardness and smoothness to permit writing on the notebook as well as providing an aesthetically appealing appearance. A hinge of the notebook secures the front and back cover flaps to the spine for movement between open and close positions.

In the preferred construction, each plywood cover flap has three plies. An inner ply of each plywood cover flap preferably has grain extending perpendicular to the elongated length of the spine, while two outer plies of each cover flap have grain extending parallel to the elongated length of the spine. One-eighth inch thick plywood is disclosed as being the most preferred thickness for providing the notebook with the requisite strength without excessive weight. Each cover flap may also have an inner surface that is at least partially exposed wood of one of the outer plies.

The hinge of the notebook is preferably embodied by a flexible hinge strip of an elongated shape extending parallel to the elongated direction of the spine to secure the cover flaps to the spine for the opening and closing movement. This flexible hinge strip has an intermediate portion that covers the exterior of the spine on the opposite side thereof as the ring assembly. The flexible hinge strip also has ends that are located between the ring assembly and the spine so as to be concealed from sight when the cover flaps are closed. While various flexible materials can be used to manufacture the hinge strip, one preferred construction utilizes adhesive backed decorative vinyl with ends that are located adjacent each other between the spine and the ring assembly.

The objects, features, and advantages of the present invention are readily apparent from the following detailed description of the best mode for carrying out the invention when taken in connection with the accompanying drawings.

BRIEF DESCRIPTION OF DRAWINGS

FIG. 1 is a perspective view of a ring type loose-leaf notebook that is constructed in accordance with the present invention with plywood cover flaps;

FIG. 2 is a side view of the notebook with the plies of one cover flap broken away to illustrate the orientation of the wood grain;

FIG. 3 is a disassembled view of the notebook with its cover flaps laid open on opposite sides of a spine to which the cover flaps are secured by a hinge and on which a ring assembly is mounted upon assembly;

FIG. 4 is a partial sectional view through one of the cover flaps to illustrate the plywood construction utilized; and FIG. 5 is an end view of the notebook with its cover flaps and the rings of its ring assembly shown open by solid line representation and shown closed by phantom line representation.

BEST MODE FOR CARRYING OUT THE INVENTION

An openable ring type loose-leaf notebook constructed in accordance with the present invention is generally indicated by 10 and includes an elongated spine 12 that is preferably made from relatively thin plywood. An elongated ring assembly 14 of the notebook is secured to the spine by suitable rivets or other conventional fasteners 16. Ring assembly 14 includes an elongated metal support 17 and a plurality of openable metal rings 18 mounted on the metal support for movement between the solid line open position and the phantom line closed position of FIG. 5. This opening and/or closing ring movement may be assisted by a manual operating tab 20. While three rings 18 are normally utilized, two, five, or any other number of a plurality of rings may also be used.

As best illustrated in FIGS. 1 and 3, the notebook 10 includes front and back cover flaps 22 and 24 each of which is made from a piece of plywood 26 of a generally uniform thickness in the range of about 0.08 to 0.18 of an inch. Plywood of a lesser thickness than this range, such as one-sixteenth inch plywood, does not have the required strength; while plywood of a greater thickness than the range is excessively heavy. Each cover flap 22 and 24 has its piece of plywood 26 provided with an exposed outer wood surface 28 that is sufficiently rigid, hard, and smooth to permit ease of writing on the closed notebook even when hand held without any other support. Also, the outer edges and corners of the cover flaps do not fray or wear as with conventional cloth or vinyl covers. Furthermore, the edges of the cover flaps are preferably sanded smooth to a rounded shape and are thus not sharp like vinyl covers that are heat bonded at the edges.

As illustrated in FIGS. 1 and 3, a hinge 30 of the notebook secures the front and back cover flaps 22 and 24 to the spine 12 for movement between the open and closed positions illustrated in FIG. 5.

As shown in FIGS. 2 and 4, the piece of plywood 26 of each cover flap has three plies, i.e. an inner ply 32, and a pair of outer plies 34 laminated by adhesive bonding to opposite sides of the inner ply. As best illustrated in FIG. 2, the inner ply 32 of the piece of plywood 26 of each cover flap has grain that extends perpendicular to the elongated length of the spine 12 while the two outer plies 34 each have grain that extends parallel to the elongated length of the spine in a perpendicular relationship to the grain of the inner ply 32.

With reference to FIG. 4, plywood having an overall thickness t of about 0.125 of an inch provides the optimum strength to weight for the piece of plywood 26 of each cover flap. The inner ply 32 which preferably has its grain extending perpendicular to the spine has a thickness $t_i$ while the two outer plies have thicknesses $t_o$. The inner ply thickness $t_i$ and outer ply thickness $t_o$ may vary from the relationship shown where $t_o$ is greater than $t_i$. The total ply thickness relationship depends on the types of wood used, such as ash, birch, mahogany, oak, walnut, etc., which can be selected to provide the best combination of strength, weight, rigidity and smoothness of the notebook during use.

It should be noted that the one outer ply 34 having the outer exposed wood surface 28 is preferably stained, varnished, lacquered, or covered with another suitable finish that exposes the wood grain in order to provide the aesthetically appealing appearance while still providing a hard writing surface. The inner exposed surface 36 of the other outer ply 34 may likewise be finished in the same way with stain, varnish, lacquer or another coating that provides a hard writing surface. This inner exposed surface may also be partially or fully covered with a vinyl or cloth covering to provide a pocket for holding loose papers in the manner conventionally done with prior art vinyl and cloth type notebooks.

It should be noted that the spine 12 can also be made from plywood of the same thickness as the cover flaps as well as being made from cardboard which is possible due to the support provided to the spine by the ring assembly 14. In addition, metal or injection molded plastic can also be utilized to provide the spine with an outwardly curved shape which is desirable for thicker notebooks.

With combined reference to FIGS. 1 and 3, the hinge 30 is preferably embodied by a flexible hinge strip 38 of an elongated shape extending parallel to the elongated direction of the spine 12 to secure the cover flaps 22 and 24 to the spine for the opening and closing movement. As best shown in FIG. 3, the width of the hinge strip is sufficiently wider than the spine 12 so as to overlap the adjacent edges of the plywood cover flaps 22 and 24 in order to permit securement thereof to the spine. The flexible hinge strip 38 has an intermediate portion 40 that covers the exterior of the spine 12 on the opposite side thereof as the ring assembly 14. The flexible hinge strip 38 also has end portions 42 that are folded over the interior of the spine 12 and the adjacent edges of the cover flaps 22 and 24 prior to the securement of the ring assembly 14. As such, the hinge strip ends 42 are located between the spine 12 and the ring assembly 14 in the assembled relationship and are thus also concealed from sight with the cover flaps 22 and 24 closed in the position of FIG. 1.

Adhesive backed decorative vinyl is utilized as disclosed for the hinge strip 38 in order to permit the securement upon contact of the hinge strip first to the exterior of the spine 12 and the adjacent edges of the cover flaps 22 and 24 and then to the interior thereof where the ends 42 are folded over and preferably located adjacent each other, as shown by phantom line representation in FIG. 3, in either an abutting or overlapping relationship. This decorative vinyl is illustrated as having a leather grain pattern so as to contrast with the wood grain of the cover flaps. It should be appreciated that while the decorative vinyl hinge strip facilitates the hinging of the cover flaps 22 and 24 to the spine 12, other flexible hinge strips can also be utilized such as cloth, leather, or other flexible material that is sewn or otherwise suitably secured to the spine 12 and the cover flaps 22 and 24.

It will be noted in FIG. 3 that the front and rear plywood cover flaps 22 and 24 are spaced slightly from the spine 12 in order to provide sufficient material to permit the hinging. At these spaced locations, it is also possible to sew through the hinge strip 38 either before or after the hinge strip is secured to the spine and the cover flaps. Such sewing before the securement of the hinge strip is thus merely through one layer and only provides a decorative appearance, whereas sewing after the securement of the hinge strip is through two layers in order to reinforce the construction of the hinge. Furthermore, it is possible to fold the side edges of the hinge strip 38 inwardly so as to provide a seam which is also sewn, either just through two layers of the hinge strip to provide a more aesthetically appealing appearance or through the hinge strip and through the adjacent cover flap in order to strengthen the hinge.

It is also possible to make the hinge strip 38 from molded or vacuum formed plastic with stitching formations at the hinging between the spine and each cover flap and at the edges of the strip as described above. In addition to such stitching formations, other decorative appearance such as the leather grain appearance illustrated or other desired patterns can also be used.

During the assembly at the hinge 30, it is possible to initially position a portion of each rivet 16 through an associated hole prior to the securement of the hinge strip 38 along its intermediate portion 40 to the spine 12. The ring assembly 14 is subsequently secured to this rivet portion by an conventional riveting operation such that the outer ends of the rivets are concealed from sight with the notebook closed. However, it is also possible to insert the rivet 16 through the hinge strip after the securement thereof to both the spine and the cover flaps such that the rivets are exposed as illustrated in FIG. 1. Either type of assembly of the ring assembly 14 is possible as may be desired.

While the best mode for carrying out the invention has been described in detail, those familiar wit the art to which this invention relates will recognize various alternative designs and embodiments for carrying out the invention as defined by the following claims.

What is claimed is:

1. A loose-leaf notebook comprising: an elongated spine having top and bottom edges that define a length of the spine, the spine having a pair of side edges that extend between the top and bottom edges thereof to define a generally uniform width, the spine having inner and outer surfaces that each extend between the top, bottom, and side edges; front and back cover flaps each of which has top and bottom edges that are spaced from each other substantially the same distance as the length of the spine, each cover flap having an inner edge located adjacent one side edge of the spine and also having an outer edge, each cover flap being made from plywood of a uniform thickness to provide a lightweight, high strength, rigid construction, each cover flap having an inner surface and also having an outer surface of exposed wood to facilitate writing on the outer surface and to provide the exterior of the closed notebook with an aesthetically appealing appearance; a hinge including an elongated strip having adhesive on one side, said hinge strip having a length and width greater than the length and width of the spine, said hinge strip being adhered to the outer surface of the spine and extending beyond the top, bottom, and side edges of the spine, the hinge strip being adhered to the cover flaps adjacent the inner edges thereof, the hinge strip being folded over the top and bottom edges of the spine and cover flaps and being adhered to the inner surface of the spine and the inner surfaces of the cover flaps adjacent the inner edges thereof; and an alongated ring assembly secured to the inner surface of the spine with the hinge strip located therebetween, and said ring assembly including a plurality of openable rings for detachably securing loose-leaf pages in the notebook.

2. A loose-leaf notebook as in claim 1 wherein each cover flap has a uniform thickness in the range of about 0.08 to 0.18 of an inch.

3. A loose-leaf notebook as in claim 1 or 2 wherein the hinge strip is of a one piece construction including an intermediate portion secured to the outer surfaces of the spine and cover flaps and including ends secured to the inner surfaces of the spine and cover flaps.

4. A loose-leaf notebook as in claim 3 wherein the ends of the hinge strip are located adjacent each other.

5. A loose-leaf notebook as in claim 1 or 2 wherein at least one cover flap has its inner surface provided by exposed wood.

6. A loose-leaf notebook comprising: an elongated spine having top and bottom edges that define a length of the spine, the spine having a pair of side edges that extend between the top and bottom edges thereof to define a generally uniform width, the spine having inner and outer surfaces that each extend between the top, bottom, and side edges; front and back cover flaps each of which has top and bottom edges that are spaced from each other substantially the same distance as the length of the spine, each cover flap having an inner edge located adjacent one side edge of the spine and also having an outer edge, each cover flap being made from plywood of a uniform thickness to provide a lightweight, high strength, rigid construction, each cover flap having an inner surface and also having an outer surface of exposed wood to facilitate writing on the outer surface and to provide the exterior of the closed notebook with an aesthetically appealing appearance; a hinge including an elongated strip having adhesive on one side, said hinge strip having a total length greater than the length of the spine and having a width greater than the width of the spine, said hinge strip having a first portion adhered to the outer surface of the spine and extending beyond the side edges of the spine and being adhered to the outer wood surfaces of the cover flaps adjacent the inner edges thereof, the hinge strip also having a second portion adhered to the inner surface of the spine and extending beyond the side edges thereof and being adhered to the inner surfaces of the cover flaps adjacent the inner edges thereof; and an elongated ring assembly secured to the inner surface of the spine with the hinge strip located therebetween, and said ring assembly including a plurality of openable rings for detachably securing loose-leaf pages in the notebook.

7. A loose-leaf notebook comprising: an elongated spine having top and bottom edges that define a length of the spine, the spine having a pair of side edges that extend between the top and bottom edges thereof to define a generally uniform width, the spine having inner and outer surfaces that each extend between the top, bottom, and side edges; front and back cover flaps each of which has top and bottom edges that are spaced from each other substantially the same distance as the length of the spine, each cover flap having an inner edge located adjacent one side edge of the spine and also having an outer edge, each cover flap being made from plywood of a uniform thickness in the range of about 0.08 to 0.18 of an inch to provide a lightweight, high strength, rigid construction, each cover flap having an inner surface and also having an outer surface of exposed wood to facilitate writing on the outer surface and to provide the exterior of the closed notebook with an aesthetically appealing appearance; a hinge including an elongated strip having adhesive on one side, said hinge strip having a length and width greater than the length and width of the spine, said hinge strip having a first portion adhered to the outer surface of the spine and extending beyond the side edges of the spine and being adhered to the outer wood surfaces of the cover flaps adjacent the inner edges thereof, the hinge strip also having a second portion adhered to the inner surface of the spine and extending beyond the side edges thereof and being adhered to the inner surfaces of the cover flaps adjacent the inner edges thereof; and an elongated ring assembly secured to the inner surface of the spine with the hinge strip located therebetween, and said ring assembly including a plurality of openable rings for detachably securing loose-leaf pages in the notebook.

8. A loose-leaf notebook as in claim 6 or 7 wherein the hinge strip is a unitary piece of tape having an intermediate portion that defines the first hinge strip portion adhered to the outer surfaces of the spine and cover flaps, and the unitary piece of tape having ends that cooperatively define the second hinge strip portion adhered to the inner surfaces of the spine and cover flaps.

* * * * *

UNITED STATES PATENT AND TRADEMARK OFFICE

CERTIFICATE OF CORRECTION

PATENT NO. : 4,747,721

DATED : May 31, 1988

INVENTOR(S) : Richard C. Horian

It is certified that error appears in the above-identified patent and that said Letters Patent is hereby corrected as shown below:

Column 4, line 58, "at" should read -- of --.

Column 5, line 4, "wit" should read -- with --.

Column 5, line 37, claim 1, "alongated" should read -- elongated --.

Signed and Sealed this

Twenty-seventh Day of September, 1988

*Attest:*

DONALD J. QUIGG

*Attesting Officer*

*Commissioner of Patents and Trademarks*